US007726999B2

(12) United States Patent
Vanzo

(10) Patent No.: US 7,726,999 B2
(45) Date of Patent: Jun. 1, 2010

(54) ELECTRICAL CONNECTOR SET

(75) Inventor: Augusto Vanzo, Bollate (IT)

(73) Assignee: Van-System S.r.l., Milan (IT)

( * ) Notice: Subject to any disclaimer, the term of this patent is extended or adjusted under 35 U.S.C. 154(b) by 291 days.

(21) Appl. No.: 12/004,402

(22) Filed: Dec. 21, 2007

(65) Prior Publication Data

US 2009/0163066 A1 Jun. 25, 2009

(51) Int. Cl.
*H01R 4/50* (2006.01)

(52) U.S. Cl. ..... 439/333; 439/335; 439/318

(58) Field of Classification Search ..... 439/318, 439/333, 335, 314
See application file for complete search history.

(56) References Cited

U.S. PATENT DOCUMENTS

| | | | | |
|---|---|---|---|---|
| 4,440,464 | A * | 4/1984 | Spinner | 439/218 |
| 4,820,185 | A * | 4/1989 | Moulin | 439/321 |
| 5,167,522 | A * | 12/1992 | Behning | 439/315 |
| 5,423,692 | A | 6/1995 | Francis | |
| 5,662,488 | A * | 9/1997 | Alden | 439/314 |
| 5,685,730 | A | 11/1997 | Cameron et al. | |
| 5,993,239 | A * | 11/1999 | Wright | 439/357 |
| 7,322,859 | B2 * | 1/2008 | Evans | 439/671 |
| 2008/0171456 | A1 * | 7/2008 | Vanzo | 439/164 |

OTHER PUBLICATIONS

Powerline+ brochure first published in Jul. 2005 by Van-System.

* cited by examiner

*Primary Examiner*—Xuong M Chung-Trans
(74) *Attorney, Agent, or Firm*—The Hill Firm; Dennis A. Gross

(57) ABSTRACT

An electrical connector set having mating male and female connectors is provided with a first lock preventing separation, the first lock consisting of standard bayonet slot on one member and a mating key on the other member and a secondary locking mechanism consisting of a rotatable spring lock ring affixedly carried by one of the members and is positioned interior a rotatable and axially movable collar carried by the associated member. The spring ring has at least one radially urged spring finger and the collar has at least one opening dimensioned to receive the spring finger. The spring ring includes an increased thickness area in an axial dimension which is engaged against an undersurface configuration of the collar so that as the collar is rotated with respect to the spring ring it will undergo axial movement. When the spring finger is positioned in the collar opening locking the collar against rotation, the collar will be positioned in its forward most axial position abutting an end surface of the mating connector preventing the mating connector from undergoing an axial movement necessary to initiate disconnection of the bayonet lock. A tool is required to press the pin against the spring radially inwardly of the collar opening to allow the collar to be manually rotated to an axially withdrawn position which will then allow disengagement of the bayonet lock.

7 Claims, 4 Drawing Sheets

ELECTRICAL CONNECTOR SET

FIELD OF THE INVENTION

This invention relates to electrical power connectors and more particularly to a connector set having both combination primary and secondary locks for maintaining the power connector set in an engaged relationship.

BACKGROUND OF THE INVENTION

Power connector sets used for high electric power connection generally consist of male and female connector members which are often provided with locking devices which interact between the two members to prevent accidental separation of the two members.

A standard type of lock is a bayonet lock where one of the members carries a key or projection which can be inserted into a groove or slot in the other member during coupling of the two members, the slot being L-shaped or J-shaped or otherwise configured. A known bayonet configuration is one that requires the key to move axially in the slot to a first axial position at or near an end of the slot before permitting rotation to occur and upon rotation requires, or allows, the key to undergo a slight axial movement in the opposite direction such that the key bearing connector cannot be rotated again with respect to the bayonet slot carrying member without the members undergoing relative axial movement towards one another.

The use of bayonet slots in coupling electrical connectors together is well known and is shown, for example, in U.S. Pat. No. 5,423,692 where a straight L-shaped bayonet slot is used which does not require retro axial movement to occur before rotation from the unlocked to the locked position.

While such bayonet connections are effective in preventing separation of the connector members when the key has been rotated into the circumferentially extending slot at the end of the axial entrance slot of the bayonet slot, they do not protect against unauthorized disconnection either intentionally or by vibration causing relative rotational movement between the connectors.

For this reason it has been proposed to provide a secondary lock which prevents the rotation of the key in the bayonet slot from its locked position in the absence of a determined secondary lock unlocking action. Preferably the determined unlocking action may require a tool to disengage the secondary lock. Such a combination of a bayonet slot and a secondary lock requiring use of a tool for intentional unlocking is shown, for example, in U.S. Pat. No. 5,685,730. The secondary lock as shown in that patent incorporates an axially spring biased pin in one of the connector members, which, upon rotation of the key in the bayonet slot, will project into a radially outer diameter open slot which is also open to an axial said face in the other member, the pin having a degree of projection less than the length of the radially open slot. The pin will prevent rotation of the two connector members by engagement of the pin with the walls of the slot. A pry tool can be used to abut the end of the pin in the slot to push it back against the spring and out of the open slot to allow rotation of the key member with respect to the bayonet slot member.

While the use of an axially projecting pin secondary lock overcomes many of the problems associated with unintentional disconnection of the connector set, it would be an improvement in the art to provide an alternative secondary locking member.

SUMMARY OF THE INVENTION

This invention provides a secondary locking mechanism for use in connection with a bayonet slot primary locking mechanism in a connector set having male and female connector members. The second locking mechanism consists of a spring ring carried by one of the members has at least one locking pin which is biased to a locking position by integrally formed spring arm section of the ring. The ring is positioned interior of a rotatable and limited actually moveable collar which is connected to and carried by the member carrying the spring ring. The collar has a locking pin receiving opening therein which the spring biased pin can snap into when the collar is in one rotational position. Movement of the pin out of the locking opening will allow the collar to be rotated to a second position circumferentially spaced from the locking position. The rotation of the collar from the locking position to the secondary position and from the secondary position to the locking position will cause the collar to undergo an axial movement.

A bayonet slot formed in the spring ring carrying member is a retrograde axial movement type slot where a key carrying member must first be inserted into the slot to a first axial position then rotated and is thereafter able to move away from the first axial position in a retrograde axial movement. Rotation of the collar causes an end face of the collar to engage an end face of the member carrying the locking key key and rotation of the collar to the locked position will force axial movement of the key carrying connector member to position the key in the bayonet slot at a point where it cannot rotate it back to the entrance slot of the bayonet slot without undergoing an axial movement which is prevented by the axial positioning of the collar. The collar will be retained in that axial position by the engagement of the spring locking pin and the collar's pin receiving opening.

The collar is provided with an access opening, which may be formed as a part of the pin receiving opening into which a tool may be inserted to push the spring pin out of the collar opening and to thereby allow rotation of the collar to occur. Upon rotation of the collar from the locked position to the second position, it will be permitted to move axially away from the opposing member of the connector set thereby allowing the opposing member and its associated key to be moved in the bayonet slot to a position where it can be rotated for disconnection.

In an embodiment of the invention the spring ring is non rotatably carried by the bayonet slot providing member and has a radially moveable locking pin positioned at the end of a cantilevered spring arm formed integrally with the locking ring, the spring arm extending in a circumferential direction. The collar has a corresponding radial opening on an inner face thereof into which the pins can project.

In an embodiment of the invention two diametrically opposed locking pins are provided, which may index into two diametrically opposed collar openings which extend into an inner diameter wall of the collar.

In an embodiment of the invention the spring ring has at least two thicknesses in the axial direction and the collar has an axial end face which has, on its inner surface, a spring ring engaging portion which will position the collar in one axial position when rotated to the locked position and which will allow positioning of the collar in a second axial position when rotated to the unlocked second position, the collar being rotatably and axially moveably carried by the connector member with the connector member having a slot into which inner diameter tabs of the collar project preventing removal of the collar member.

In an embodiment of the invention a hinged tool is provided having circuit arms dimensioned to straddle the collar, the arms having inwardly directed projections receivable in openings in the collar to push the spring pins out of the collar's spring pin openings.

Other features and objects of this invention will be apparent to those skilled in the art from the following description of a preferred embodiment.

BRIEF DESCRIPTION OF THE DRAWINGS

As shown in FIG. 2, a connector assembly 10 consists of a first connector member 11 and a second connector member 12. The first connector member may be considered a male member having an interior plug 13, which is positioned interior of a shroud 14 having an open endface 15 surrounding an opening 16, which has an inner diameter larger than the outer diameter of the plug 13. The connector member 12 may be considered the female member and has a socket 17 for receipt of the plug 13, the socket being defined by a housing extension 18, which is dimensioned to be received within the opening 16 of the member 11. Both members 11 and 12 may be provided with knurling 20 to grasp the members 11 and 12 for manual manipulation during connection and disconnection. The connection of the connector set is made simply by pushing the two members 11 and 12 together with the portion 18 of member 12 being received through the opening 16 and being forced into the opening a distance sufficient for the plug 13 to be received in socket 7. Full seating of the connectors will occur when the plug 13 extends to the proper depth in the socket 17.

Figure 1:
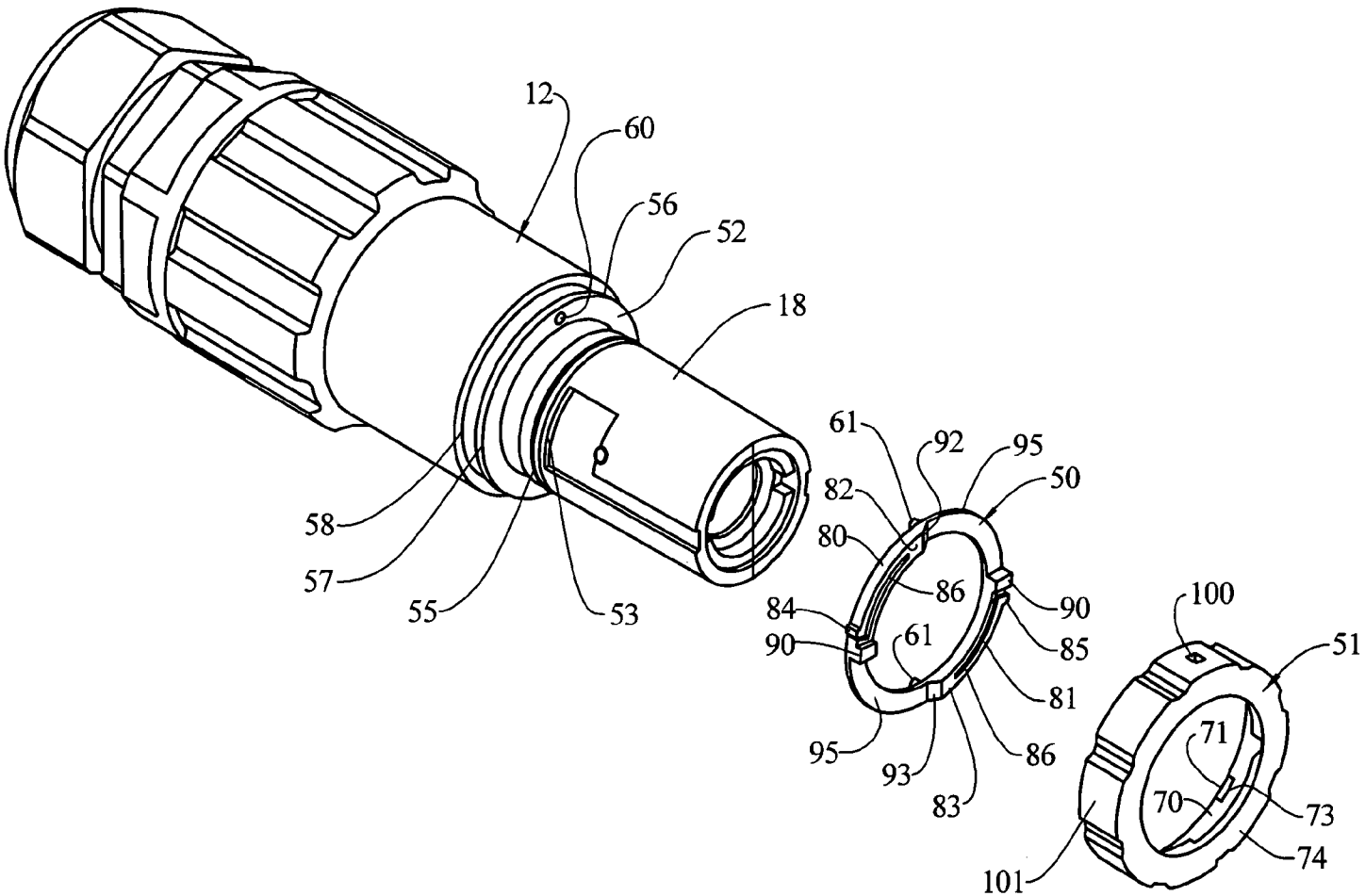
FIG. 1 is an exploded view of the female connector member.

To maintain the members 11 and 12 in contact a bayonet connection is provided. Member 12 is provided with an outer diameter slot 19 having an axially extending entry slot 22 which is relatively circumferentially narrow and which terminates in a circumferentially wider bayonet slot base portion 23. A key 24 is affixed to the inner diameter wall 16*a* of opening 16 and is dimensioned to be received in the entry slot 22 of bayonet slot 19. The bayonet slot 19, 22, 23 functions along with the key 24 to provide for retrograde motion between the members 11 and 12 during rotation of the key 24 fully into the bayonet slot portion 23. Although there are many known ways of providing for such retrograde motion, the preferred embodiment utilizes a metal pin 30 which projects into the slot area 23 from its forward wall 23*a*. A corresponding pin 31 associated with key 24 and projects beyond the innermost end 24*a* of key 24. The two pins 30 and 31 therefore engage each other during rotation of the key within the slot 23 causing the member 11 to move further into joined position with member 12 then would be required by simply engaging the end surface 24*a* of the key with the end surface 23*a* of the bayonet slot section 23. After the pin 31 has moved circumferentially past pin 30, the member 11 can then be backed partially away from member 12 until such time as the pin 31 contacts the surface 23*a*. The dimensioning of the pins may be chosen as desired but will have a sufficient projection beyond their respective associated surfaces, the wall 23*a* for pin 30 and the end 24*a* of key 24 for pin 31 so as to allow a sufficient degree of retrograde movement for the secondary locking purposes as hereinafter described. As will be understood from the further description, when the pin 31 is bottomed against wall 23*a*, the key cannot be rotated from the bayonet slot 23 to the entrance slot 22 without axial movement of the members with the member 11 moving further in the direction of the member 12.

It will be appreciated that the existence of the bayonet slot and the key 24 provides a first lock preventing separation of the members 12 and 11. When the key 24 has been rotated into the section 23 of the slot 19, axial separation movement of the members is prevented by bottoming of the key against the wall 23*a*. Thus, in order to separate the members 11 and 12, the members must be rotated with respect to one another to align the key 24 with the entry slot 22.

Figure 2:
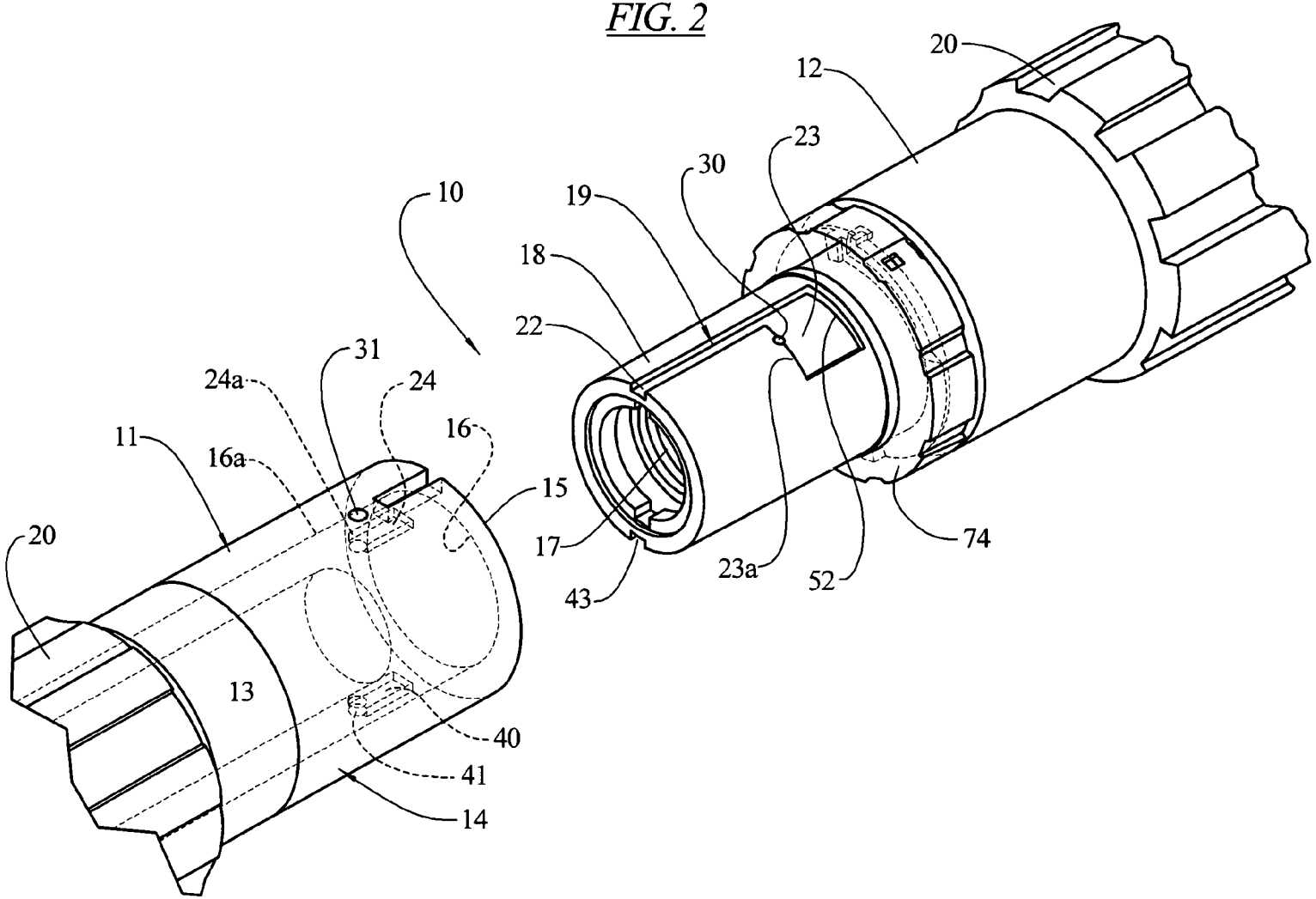
FIG. 2 is a fragmentary view of the male and female connector members showing, by dotted lines, internal features.

As is shown in FIG. 2, a second key 40 having a second pin 41 may be provided diametrically opposed to the key 24 and may work with a second slot 43 which is substantially the same as the slot 19 and diametrically opposed to slot 19. The use of two bayonet slots, and associated keys, maintains a balanced primary lock.

Although a substantially L-shaped bayonet slot has been shown, except for the protrusion of the pin 30, it will be understood that an angled bayonet slot may be utilized, particularly one where the portion of the circumferentially extending bayonet portion 23 from the entrance slot to the pin is angled axially towards the main body of the connector member 12. Use of such an angled bayonet slot will cause the member 11 to move further into complete seated engagement with respect to member 12 during the twisting operation. Such angled bayonet slots are well known to those skilled in the art.

As shown best in FIG. 1, member 12 includes a secondary locking feature which employs a locking ring 50 and a collar 51. The ring 50 may preferably be molded or machined of resilient plastics material and is positioned against a face 52 of the member 12 which extends radially outwardly beyond the diameter of the housing section 18 and which is in spaced relation to the end wall 53 of the bayonet slot section 23. Intermediate the end wall 53 and the face 52 an O-ring seal 55 may be circumferentially received around the housing extension 18.

A groove 56 is provided in the member 12 on the side of the face 52 opposite the housing extension 18. Thus, the face 52 is formed as the front face of a circumferential ring 57 extending radially outwardly from the housing extension 18 and radially outwardly from the bottom of the groove 56. The ring 57, which is an integral portion of the housing 12, is provided with openings 60 open to the face 52 which are dimensioned to receive projections 61 on a back surface of the spring ring 50. Thus, with the projections 61, which are shown as round pins, received in the openings 60, which are shown as pinholes, the spring ring 50 will be carried against the face 52 and will not be rotatable with respect to the member 12. Preferably two or more pins 61 and associated pinholes 60 are provided circumferentially spaced from one another. The spring ring 50 will be fixedly carried by the ring 57. Other methods of rotationally restrictive attachment of the spring ring 50 to the member 12 may also be utilized, such as, for example, adhesives and bolts.

The collar 51 is received over the ring 57 and spring ring 50 and has an inner diameter 70 approximately equal to the outer diameter of the ring 57. Projections or tabs 71 on the inner diameter of the collar are received in the groove 56 to retain the collar on the member 12. The tabs 71 have an axial dimension less than the axial extent 56 such that the collar is moveable axially within limits with respect to the remainder of the members 12. The limits of movement are defined by the engagement of the axial ends of the tabs 71 at the open end of the collar with the back wall 58 of the groove 56 and the engagement of the other end of the tabs 71 with the front wall of the groove formed by the backside of the ring 57.

The collar 51 is rotatable with respect to the member 12 but has an inner diameter surface 70 terminating at a reduced diameter open end wall 74. The thickness of the end wall 74 varies circumferentially and is designed to accommodate thickness variations in the spring ring 50. As shown in FIG. 1, the spring ring 50 may employ two cantilevered spring arms 80 and 81 which are cantilevered in the circumferential direction from transition points 82, 83 and which terminate in free ends 84, 85 which have outturned radial projections forming the pins. The slot 86 between the spring arms 80, 81 and the radially inner portion of the spring ring 50 underlying the cantilevered arms 80, 81 allows for movement of the spring pins radially inwardly and outwardly with respect to the remainder of the ring.

The circumferential sections forming the cantilevered spring arms are axially thicker than remaining portions of the spring ring extending between stops 90 and the points 82, 83 of the ends of the cantilevered spring arms 80, 81. The internal end wall of the collar 51 is dimensioned to mate with and ride against the front surfaces of the ring 50. It will therefore be seen that rotation of the collar will bring axially thicker portions of the inside face of the collar end wall into engagement with the transition points 82 and 83 which are provided with sloped surfaces 92 and 93. Further rotation of the collar will therefore cause the collar to move axially away from the back wall 58 of the groove 56 and towards the end wall 53 of the bayonet slot. Rotation of the collar will be stopped by abutment with the raised bosses 90. At that point, the spring projections 84, 85 at the ends of the spring fingers will snap into correspondingly configured openings 100 extending into or through the skirt 101 of the collar 51, it being understood that the inner diameter wall 70 of the collar will have kept the spring fingers in a compressed condition until aligned with the openings 100. With the spring finger projections extending into the opening 100, the collar will be locked against further rotational movement.

During the rotation from the unlocked second position to the locked first position, the axial movement of the collar 51 will bring it's face 74 into contact with the face 15 of member 11 and will force member 11 away from member 12. The extent of movement will be such as to cause the pins 30 and 31 to overlap each other in an axial direction.

If, at the time the collar 51 is rotated to the locked position with the projections at the ends of the spring fingers extending into the openings 100, and the key 24 has been rotated to the locked position within the area 23 of the bayonet slot, the axial force exhorted by the collar during the rotation to the locked position will be sufficient to have moved the pin 31 sufficiently close to the back wall 23*a* so as to cause an interference position will respect to the pins 30, 31.

In this position the member 11 cannot be rotated with respect to the member 12 sufficiently to align the key 24 with slot 22 thereby allowing separation of the connector members. The member 11 cannot be moved axially towards the member 12 sufficient to eliminate the axial overlap of the pin by reason of the abutment of the face 74 of the collar 51 with the end 15 of the shroud 14.

Figures 9, 10:
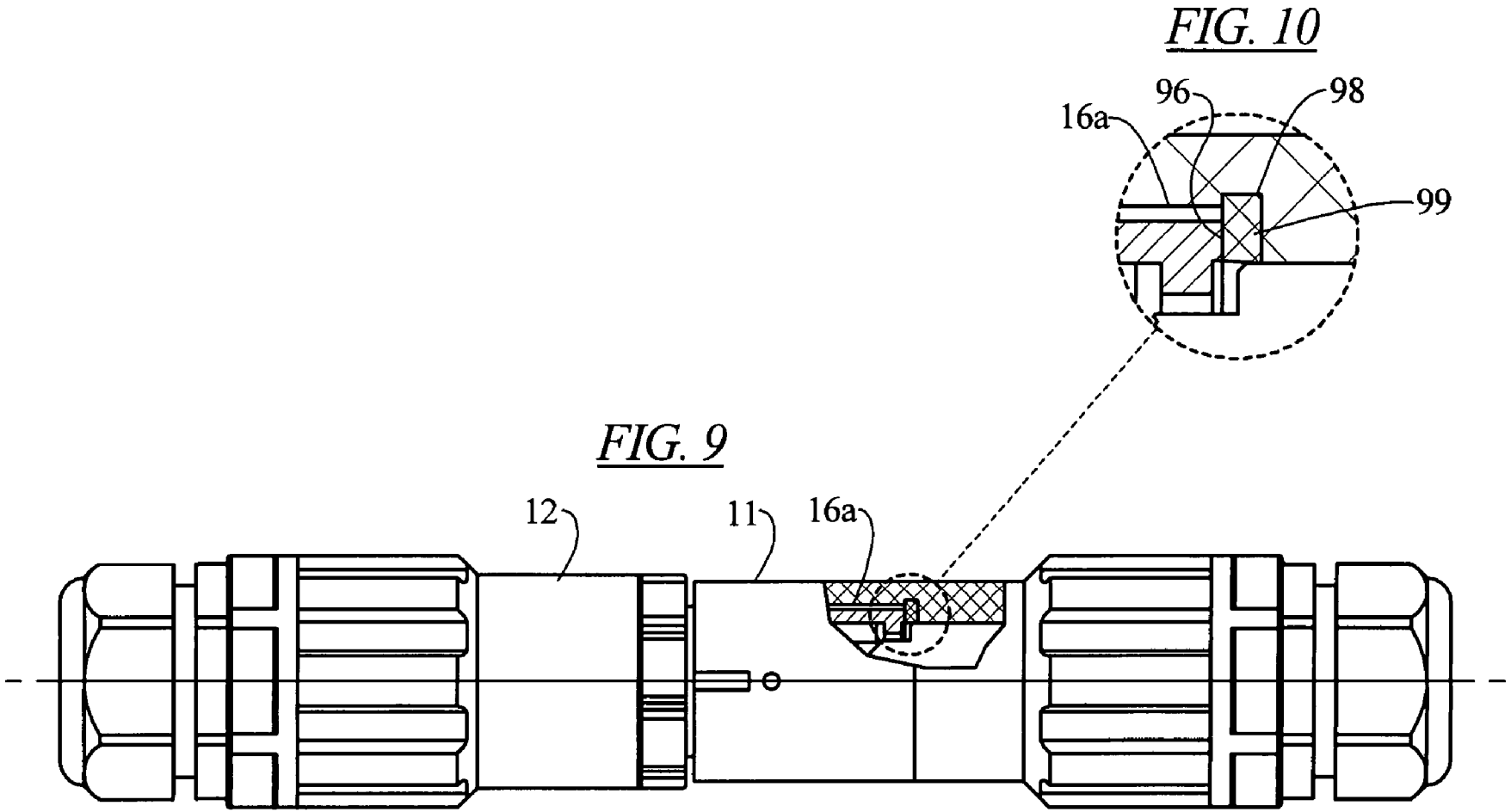
FIG. 9 is a side plan view, partially in section, of the coupled together connector members.
FIG. 10 is an exploded view of the indicated section of FIG. 9.

FIG. 9 and its enlarged section FIG. 10 show an additional feature for assisting in assuring that the rotated members are retained in the pin overlapped position. A groove 98 may be provided at the back of the inner diameter wall 16*a* of member 11 as that wall is stepped down in a radially inward direction. The stepped wall and groove 98 then provides a space for a resilient elastomeric ring 99 to be received in the groove 98 and to be abutted by the end face 96 of member 12. The end face 96 may be provided with a slight outer diameter protrusion specifically adapted to engage the resilient ring 99. During the seating of the members together the end face of member 12 will be brought into engagement with the resilient ring at a point before the pins 30, 31 are axially positioned for rotation of the members with respect to one another to the locked position. Therefore, in order to rotate the members to the bayonet slot pin overlapped locked position, it is necessary to compress the resilient ring 99 through the application of axial force urging the two members together. Upon release of that axial force, the resilient ring 99 will urge the end face 96 of member 12 towards the open end of member 11 thus placing the pins in an axially overlapped position preventing reverse rotation necessary to unlock the members from the fully bayonet-locked position.

This same resilient ring compression technique may be used with different shapes of bayonet locks, and the use of pins 31 is not required where the keys 24, 40 themselves can be urged into a short return leg of an L-shaped bayonet slot. The resilient ring will thus be seen to have the ability to work in cooperation with the axial movement of the face collar 74 and its engagement with the face 15 of member 11 to maintain the members 11 and 12 in their locked position even without engagement of the projections 84, 85. In this embodiment, the first lock can be secured against accidental release by the use of the resilient ring even if the collar 51 has not been positioned to activate the secondary lock.

By depressing the spring fingers 80, 81 to allow the projection 84, 85 to be free of the opening 100, the collar 51 can be rotated, for example in the clockwise direction in FIG. 1 to bring the thicker portions of the undersurface of the front 74 to a position where they overlie the reduced thickness of sections 95 and thinner sections of the undersurface will overlie the increased thickness sections associated with the spring fingers. At that point the collar 51 can be moved away from wall 15 of member 11 allowing member 11 to be moved axially with respect to member 12 to eliminate the overlap of the pins and to allow the key to be rotated within the bayonet slot to align it with the entrance channel.

Although the preferred embodiment utilizes Varying thicknesses of the spring ring and of the inside surface of the front wall 74 of the collar to force axial movement of the collar, it will be readily appreciated that other structures may be utilized. For example, the collar may be in threaded engagement with threads on the outer diameter of the ring 57, which may have a greater axial extent, such that rotation of the collar with respect to the member 12 will cause axial movement by reason of the engagement with threads. It will also be appreciated that within the embodiment shown the sloped surfaces 92, 93 will generally mate with similarly sloped surfaces formed into the inner diameter wall of the collar and that the surfaces will act together as camming surfaces converting a portion of the rotational force being exerted against the collar into an axial force. The slope may be chosen to provide the desired axial force to circumferential turning force ratio, it being recognized that once the male and female members are in plug and socket seated condition, the frictional engagement between the plug and socket will resist axial movement of the two members.

Figure 3:
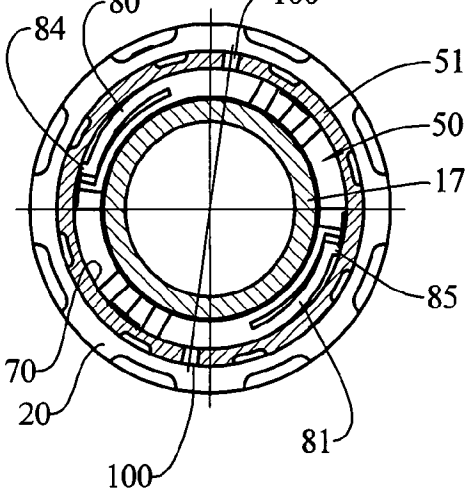
FIG. 3 is a partially diagrammatic sectional view of the connector of FIG. 2 showing the spring ring axially inside of the collar endface, which is not shown.

FIG. 3 shows the locking ring in the collar in the unlocked position where it will be seen that the cantilevered spring arms 80, 81 have their end projections or pins 84, 85 pressed against the inner diameter wall 70 of the collar 51. The ends 84, 85 are circumferentially spaced from the pin openings 100. In this position the collar is free to rotate and may be moved axially back and forth in the groove 56.

Figure 5:
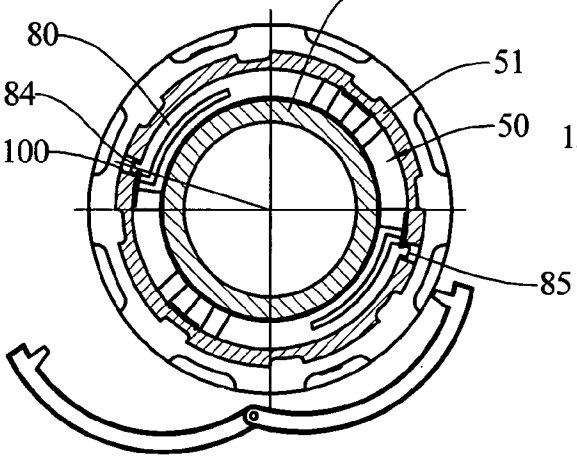
FIG. 5 is a view similar to FIG. 3 showing the spring ring in the locked position.

FIG. 5 is a view similar to FIG. 3 showing the spring ring in the locked position. The collar has been rotated from the position shown in FIG. 3 to align the pinholes 100 with the end pins 84 and 85 so that the cantilevered arms have biased the pins into the openings. In the preferred embodiment the projections or pins 84, 85 do not extend through the collar to the outer diameter surface of the collar but do extend into the openings 100 to a sufficient extent to prevent rotation of the collar. In this position the collar cannot be rotated and has been axially moved during the rotation from the position of FIG. 3 to the position of FIG. 5 to the point where the face 74 of the collar will engage the face 15 of shroud 14 preventing axial movement of the member 11 with respect to the member 12.

Figure 7:
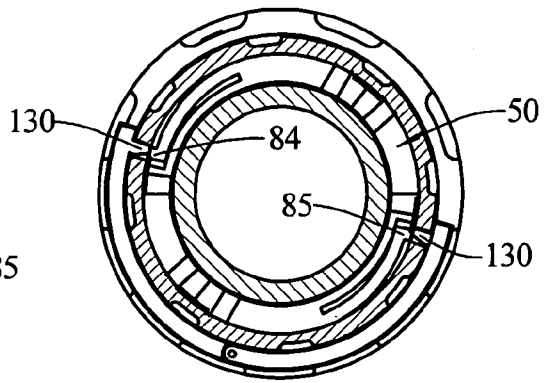
FIG. 7 is a view similar to FIG. 5 showing the tool in the position unlocking the spring fingers, pins.
Figure 6:
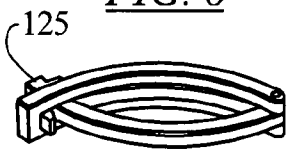
FIG. 6 is a perspective view of the tool in a collapsed or folded condition.
Figure 4:
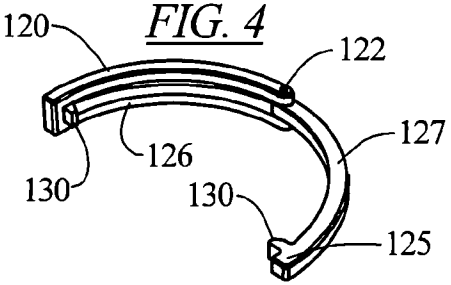
FIG. 4 is a perspective view of a tool for release of the secondary lock.

A tool is provided for depressing the pin projections in the openings 100. A tool specifically adapted for that purpose is shown in FIG. 4 in its open position and in FIG. 5 in its collapsed position. The tool consists of two arms 120 and 121 which are hingedly connected together at 122. The arm 120 is a split arm and is dimensioned longer than the arm 121 so that the tool can be closed as shown in FIG. 6 with the end 125 of the arm 121 extending through the slot 126 in the arm 120. Each arm is provided with a projection 130 which is dimensioned to be received in one of the openings 100. As is shown in FIG. 5 the tool may be opened to span the collar and when brought into engagement with the collar as shown in FIG. 7, the projections 130 will extend into the openings 100, engage the pin ends 84 and 85 of the spring and press the spring ends out of the openings 100 thereby allowing the collar 51 to be rotated from the locked position of FIG. 5 to the unlocked position of FIG. 3. At that point the collar is once again free to move axially in the groove 56 thereby allowing member 11 to be moved with respect to member 12 to eliminate the axial overlap of the pins 30, 31 such that the keys may be aligned with the entrance channels of the bayonet slots.

Figure 8:
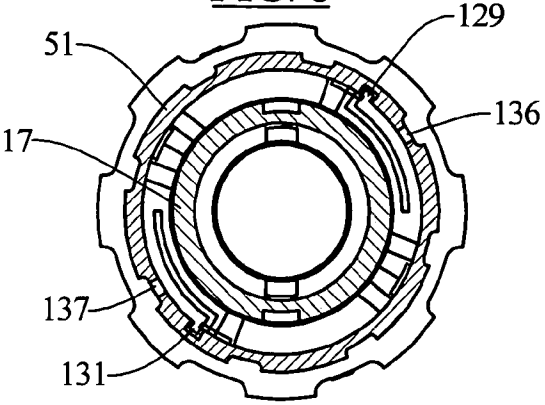
FIG. 8 is a view similar to FIG. 5 showing an alternative location of the tool receiving openings.

FIG. 8 illustrates a secondary lock similar to that shown in FIGS. 3, 5 and 7 but one wherein the collar is provided with blind bores or pinholes 129, 131 for receipt of the projections or pins 84, 85 of the springs. Spaced openings 136, 137 circumferentially spaced from the blind holes 129, 131 provide access for the ends 130 at the tool at which point the ends will contact the cantilevered leg of the spring fingers and will push the fingers out of the blind holes. This modification both disguises the locking function since nothing will be seen to project into the openings 136, 137 and may have some beneficial aspects in severe environments where the openings 100 may become blocked, such as by ice, which could have the effect of freezing the pin projections in the holes.

As will be readily apparent to those skilled in the art, modifications of this structure can be provided. For example, the locking pins projecting from the end of the cantilevered spring arms could extend axially and the spring arms be formed axially of the spring ring rather than circumferentially. In that instance the openings 100 would be placed in the front face 74 of the collar in a position radially outwardly of the contact with the skirt 14. The remaining features of preventing axial movement and allowing axial movement of the collar while engaging the face 15 of the shroud 14 can still be retained such that the secondary lock acts by preventing axial movement of the members with respect to one another.

Other modifications will also be available to persons of ordinary skill in the art. Although I have set forth my invention in connection with a preferred embodiment, it will be recognized that that is only one possible construction and that others may wish to use my invention in different forms, employing different materials or modified features.

I claim as my invention:

1. An electrical connector set having first and second connector members with the first of said members having an open end which receives an end of the second of said members, the second of said members having a bayonet slot with an entrance channel in an outer surface thereof and the first of said members having a bayonet key dimensioned and positioned to be received in said slot upon insertion of the one member into the other member, the key being rotatable with respect to an entrance channel of the slot into an offset portion of the slot preventing separation of the members by reason of engagement of said key with an end wall of the offset portion of said slot, the second member having a rotatable and axially moveable collar positioned to abut an end of the first member and moveable between a first axial position where the first member is free to move axially and rotationally to remove the key from the slot and a second axial position where the first member is prevented from undergoing an axial movement required to allow the key to be rotated in the offset portion of the slot.

2. A connector of claim 1 wherein the bayonet slot has a circumferentially extending leg extending from an entrance channel and wherein the key can be moved into the circumferentially extending portion of this bayonet slot by rotation of the first member with respect to the second member, the circumferential extension of the slot and the key having mutually engageable surfaces limiting relative rotational movement of the first member and the second member when the first and second members are in a first axial position relative to one another, the surface features being moveable away from one another when the first and second members move from the first axial position to a second axial position, the key being rotatable out of the circumferential extension of the slot when the members are in the second axial position.

3. The connector of claim 2 wherein the second member has a spring biased lock pin which is moveable between a first position and a second position, the first position allowing rotation of the collar, the second position preventing rotation of the collar, movement of the spring from the first to the second position being in dependent response to rotation of the collar, the collar and the second member having axially opposed surfaces which cause the collar to move axially with respect to the second member upon rotation to the spring locked position.

4. The connector of claim 3 wherein the collar and second members axially opposed surfaces comprise an undersurface of an open end wall of the collar, the outer surface of which can be brought into engagement with an end surface of the first member, the second member axial surface being formed integrally with the spring member.

5. A power connector comprising:

(a) first and second connector portions for connection to respective power conductors (b) a bayonet locking mechanism for locking said connector portions upon rotation of said first and second connector portion in a first direction relative to each other and unlocking said connector portions upon rotation of said first and second connector portions in an opposite direction relative to each other; and (c) a secondary locking mechanism for preventing rotation of said first and second connector portions in said opposite direction relative to each other, said secondary locking mechanism being comprised of an axial retrograde motion bayonet locking mechanism wherein when the first and second connector portions are in a first axial position with respect to one another rotation in said opposite direction is permitted and when said first and second connector portions are in a second axial position relative to one another and have been rotated in the first direction relative to each other, the connector portions cannot be rotated in the opposite direction, the secondary locking mechanism further comprising an axially moveable member on one of said portions moveable between a first and second axial position, said axially moveable member when in the first position preventing axial movement of the first and second power connector portions from the first axial position of the bayonet locking mechanism to the second axial position of the bayonet locking mechanism and a selectively disengageable lock member for retaining said axially moveable member in the first position and upon disengagement allowing movement to the second position.

6. An electrical connector set having male and female connector members with a first lock for preventing accidental disconnection comprising a bayonet slot lock and a second lock selectively preventing axial movement of the male member with respect to the female member in an axial movement required for unlocking the bayonet lock, the secondary lock being selectively releasable to allow such movement to occur; wherein the secondary lock prevents axial movement of the male member with respect to the female member and the bayonet slot lock is a retrograde movement bayonet lock; wherein the male member is equipped with a key for fitting in the bayonet slot, the female member is provided with a bayonet slot, the female member carrying an axially moveable member moveable between a first axial position in which is engages a portion of the male member preventing axial movement of the male member with respect to the female member in an axial direction necessary for unlocking the bayonet lock, the axially moveable member having a second position allowing axial movement of the male member with respect to the female member to allow unlocking of the bayonet lock; wherein the axially moveable member is retained in the first position by radially projecting spring biased pins interior of the axially moveable member, the spring biased pins being accessible through radial openings through the axially moveable member by tools to displace the springs to unlock the axially moveable member.

7. The connector set of claim 6 wherein the female connector member has an inner diameter ledge faced with a resilient ring and positioned to be engaged by the end face of the male member upon insertion of the male member into the female connector member prior to a depth of penetration of the male member necessary to allow rotation of the male member with respect to the female member to place the key into a position to be rotated in the bayonet slot to a fully rotated position, the resilient ring being compressible to allow the key to be rotated to such position and resilient to thereafter urge the male member and the key to a locked position in which the key is prevented from reverse rotation to withdraw it from the bayonet slot.

* * * * *